United States Patent [19]

Oguro

[11] 4,205,256

[45] May 27, 1980

[54] MAGNETRON SUPPORTING STRUCTURE

[75] Inventor: Tomokatsu Oguro, Mobara, Japan

[73] Assignee: HitachiLtd., Tokyo, Japan

[21] Appl. No.: 918,811

[22] Filed: Jun. 26, 1978

[30] Foreign Application Priority Data

Aug. 10, 1977 [JP] Japan ..... 52/106174[U]

[51] Int. Cl.[2] ..... H01J 25/50

[52] U.S. Cl. ..... 315/39.51; 315/39.53; 219/10.55 B

[58] Field of Search ..... 315/39.51, 39.53, 39.75; 219/10.55 B

[56] References Cited

U.S. PATENT DOCUMENTS

| | | | |
|---|---|---|---|
| 3,733,455 | 5/1973 | Foerstner et al. | 219/10.55 B |
| 3,967,087 | 6/1976 | Kanuma | 315/39.51 |
| 4,044,279 | 8/1977 | Tsuzurahara et al. | 315/39.51 |

*Primary Examiner*—Saxfield Chatmon, Jr.
*Attorney, Agent, or Firm*—Dike, Bronstein, Roberts, Cushman & Pfund

[57] ABSTRACT

In a magnetron device of the type wherein a magnetron tube is supported by a supporting plate and a waveguide is clamped to the magnetron tube through a metal gasket, the edge of an opening provided for the waveguide is urged against the supporting plate via the metal gasket.

4 Claims, 5 Drawing Figures

MAGNETRON SUPPORTING STRUCTURE

BACKGROUND OF THE INVENTION

This invention relates to a magnetron device, more particularly to coupling means between a magnetron and a unit with which the magnetron is combined.

When combined with a unit such as for example a microwave oven, a magnetron generally produces a microwave output to the unit with high efficiency so that such microwave oven is widely used to heat and defrost foodstuffs.

FIG. 1 is a diagrammatic representation of one example of a prior art magnetron device. As shown, the magnetron device comprises a magnetron tube 1 including a cylindrical anode electrode 1*a* having radial vanes secured to the inner surface of the anode electrode, a cathode electrode, not shown, concentrically disposed with the anode electrode, a cathode input 1*b* for supplying operating current to the filament of the cathode electrode, and an output terminal 1*c* for radiating to the outside the microwave generated in the interaction space defined between the vanes and the cathode electode. A plate 2 for mounting the magnetron tube 1 to a casing of the microwave oven, heat radiating fins 3 for rodiating the heat generated in the anode 1*a*, and a shield casing 4 for shielding the cathode input 1*b* are secured to the outside of the cylindrical anode 1*a* by force fitting or shrink fitting. A seat ring 5*a* is secured to the upper surface of the magnetron tube 1 for receiving a metal gasket 5 made of brass or stainless steel. A waveguide 6 covers the output terminal or antenna 1*c* and made up of upper and lower plates 6*a* and 6*b*. The lower plate 6*b* is provided with an opening 6*c* for passing the output terminal 1*c* and the lower edge 6*d* of the opening is urged against the gasket 5. The waveguide 6 is fastened to the supporting plate 2 by bolts 7. Thus, the magnetron tube is suspended by an annular shoulder 2*a* of the supporting plate 2.

With this construction, however, when the bolts 7 are tightened, a large pressure is applied to the upper end of the magnetron tube by the edge 6*d* of the opening 6*c* through the gasket 5. As a consequence, a force shown by arrows tends to disengage the magnetron tube from the supporting plate 2. For this reason, it has been necessary to use a strong force fit or to use some means that can prevent disengagement of the magnetron tube. Moreover, as the opening 6*c* of the waveguide 6 is positioned close to the output terminal or antenna 1*c*, a spark 20 tends to occur between these elements as shown by dotted lines, thus decreasing the reliability of the magnetron device.

SUMMARY OF THE INVENTION

Accordingly, it is the principal object of this invention to provide an improved mounting structure for efficiently connecting a magnetron tube to the unit combined with the magnetron, which can prevent disengagement of the magnetron tube and objectionable sparks.

According to this invention, there is provided a magnetron device comprising a magnetron tube having an output terminal at one end thereof, a unit which is combined with the magnetron tube through a metal gasket, and supporting means connected to the periphery of the magnetron tube near the output terminal for supporting the magnetron tube, wherein the metal gasket is mounted on the supporting means whereby the edge of an opening provided for the unit for receiving the output terminal is urged against the supporting means through the metal gasket.

DESCRIPTION OF THE PREFERRED EMBODIMENTS

Figure 1:
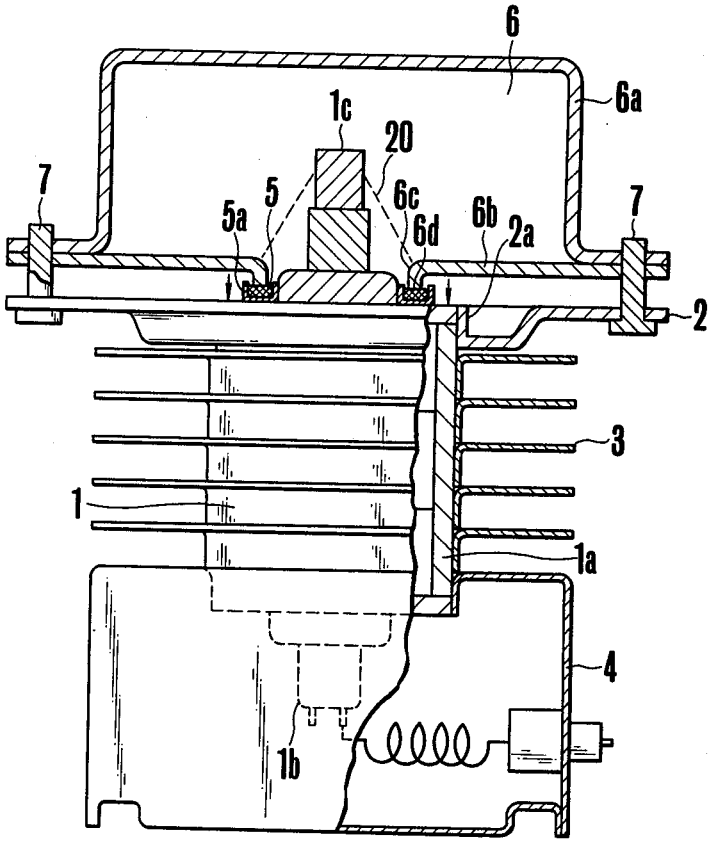
FIG. 1 (PRIOR ART)
FIG. 1 is a side view, partly in section, showing one example of the prior art magnetron device.
Figure 2:
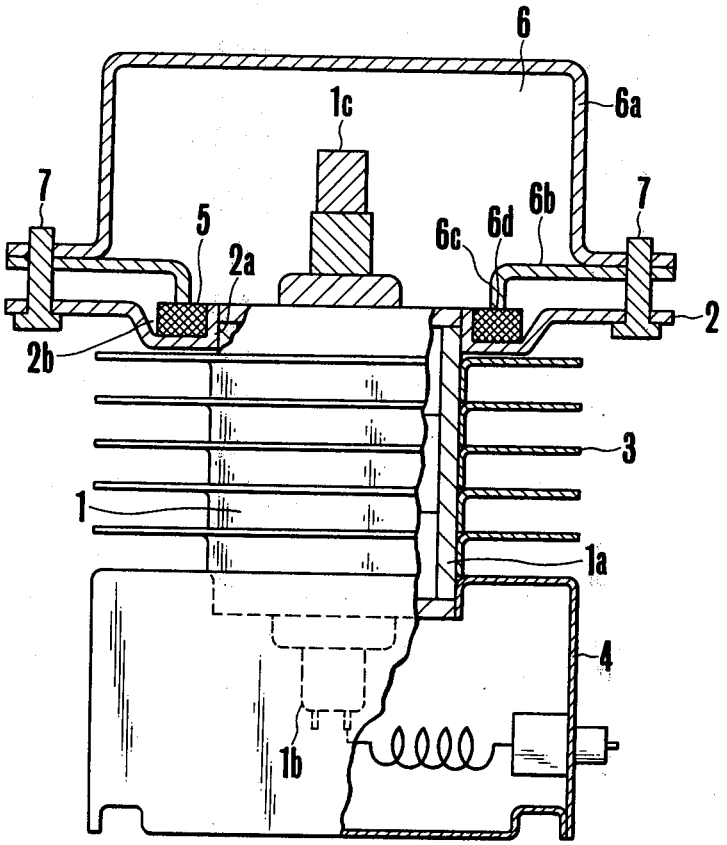
FIG. 2 is a side view, partly in section, showing one embodiment of the magnetron device embodying the invention.

In the embodiment of this invention shown in FIG. 2, elements corresponding to those shown in FIG. 1 are designated by the same reference numerals. According to this invention, adjacent the shoulder 2*a* at which the magnetron tube 1 is force fitted, there is provided an annular groove 2*b* for receiving the metal gasket 5 which prevents leakage of high frequency energy, and the lower edge 6*d* of the opening 6*c* of the waveguide 6 is urged against the gasket by mounting the waveguide 6 on the supporting plate 2 by means of bolts 7. Thus, the inner side of the gasket 5 contacts the outer surface of the upwardly extending shoulder 2*a*.

With this improved construction, as the bolts 7 are tightened, the pressure applied by the lower edge 6*d* of the opening 6*c* is received by the gasket 5 on the supporting plate 2 and never transmitted to the magnetron tube 1. Accordingly, the magnetron tube 1 will not be disengaged from the supporting plate 2 and it is not necessary to use gasket receiving seat ring as in the prior art shown in FIG. 1. Furthermore, as the distance between the output terminal 1*c* and the opening 6*c* of the waveguide 6 is increased, spark can be decreased, thus improving reliability.

Figure 3:
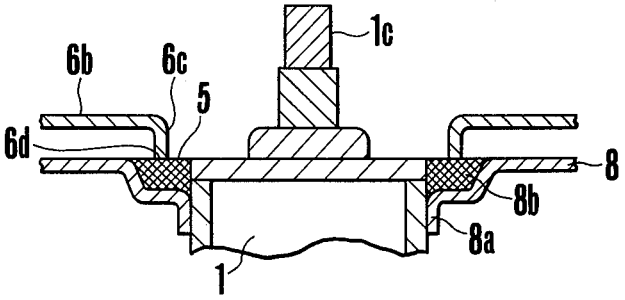
FIGS. 3, 4 and 5 are partial sectional views showing various modifications of this invention.
Figure 4:
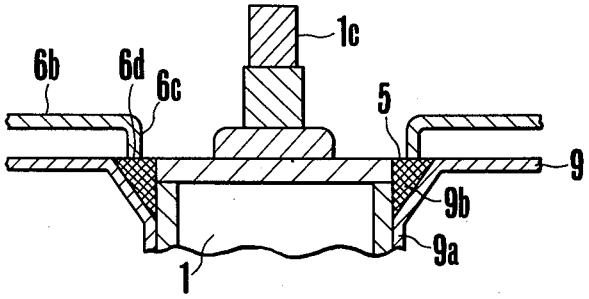
Figure 5:
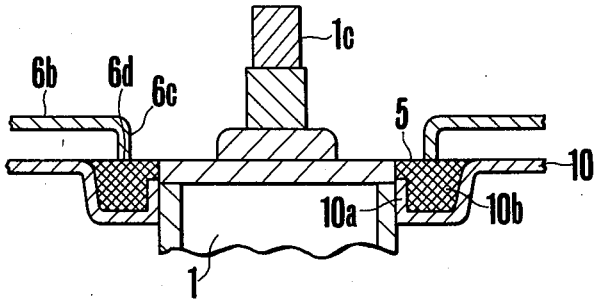

FIGS. 3 to 5 show modified embodiments of this invention which are different from the embodiment shown in FIG. 2 in that shoulders 8*a*, 9*a* and 10*a* of the mounting plates 8, 9 and 10, respectively are shaped such that the inner side of the metal gasket 5 will come in direct contact with the outer periphery of the magnetron tube 1 and that the lower edge 6*d* of the opening 6*c* of the waveguide will be urged against the metal gasket.

More particularly, in the embodiments shown in FIGS. 3 and 4, the inner ends 8*a* and 9*a* of the mounting plates 8 and 9 are bent downwardly to form recesses 8*b* and 9*b* whose inner sides are opened. Thus, the metal gasket 5 placed in these recesses would come into direct contact with the periphery of the magnetron tube 1. In the modification shown in FIG. 5, the upper portion of the fit shoulder 10*a* is cut away so as to cause the upper portion of the gasket 5 to contact directly with the periphery of the magnetron tube 1.

In addition to the advantage of the embodiment shown in FIG. 2, since the modifications shown in FIGS. 3 through 5 permit direct contact between the metal gasket 5 and the magnetron tube, it is possible to greatly decrease the leakage of the microwave.

As described above, according to this invention, it is possible to prevent sparks between the output antenna of the magnetron tube and the waveguide and disegagement of the magnetron tube from the waveguide, thus improving the reliability of the magnetron device.

What is claimed is:

1. In a magenetron device comprising a magnetron tube having an output terminal at one end thereof, a unit which is combined with the magnetron tube through a metal gasket, and supporting means connected to the periphery of said magnetron tube near said output terminal for supporting the magnetron tube, the improvement wherein said metal gasket is mounted on said supporting means such that the edge of an opening provided in said unit for receiving the output terminal is urged against said supporting means through said metal gasket.

2. The magnetron device according to claim 1 wherein the inner edge of said supporting means in contact with said magnetron is bent downwardly to form an annular groove to receive said metal gasket.

3. In a magnetron device comprising a magnetron tube having an output terminal at one end thereof, a unit which is combined with the magnetron tube through a metal gasket, and supporting means connected to the periphery of said magnetron tube near said output terminal for supporting the magnetron tube, the improvement wherein said metal gasket is mounted on said supporting means such that the edge of an opening provided in said unit for receiving the output terminal is urged agaisnt said supporting means through said metal gasket, and wherein said supporting means comprises a flat plate having a fit shoulder which is force fitted onto the outer periphery of sai dmagnetron tube, said fit shoulder defining an annular recess for accommodating said metal gasket.

4. The magnetron device according to claim 3 wherein the upper portion of said fit shoulder is partly removed so as to cause a portion of said metal gasket to come into direct contact with said magnetron tube.

* * * * *